US006612370B1

(12) United States Patent
Jahnsen et al.

(10) Patent No.: US 6,612,370 B1
(45) Date of Patent: Sep. 2, 2003

(54) COMPOSITE HYBRID RISER

(75) Inventors: Ove F. Jahnsen, Oslo (NO); Per-Ola Baalerud, Oslo (NO)

(73) Assignee: Kvaerner Oilfield Products AS, Lysaker (NO)

( * ) Notice: Subject to any disclaimer, the term of this patent is extended or adjusted under 35 U.S.C. 154(b) by 168 days.

(21) Appl. No.: 09/690,049

(22) Filed: Oct. 16, 2000

Related U.S. Application Data

(63) Continuation of application No. PCT/NO99/00122, filed on Apr. 15, 1999.

(30) Foreign Application Priority Data

Apr. 16, 1998 (NO) ..... PI9981701

(51) Int. Cl.[7] ..... E21B 17/01
(52) U.S. Cl. ..... 166/367; 405/224.2
(58) Field of Search ..... 166/367, 350; 405/224.2, 224.3, 224.4

(56) References Cited

U.S. PATENT DOCUMENTS 3,517,110 A * 6/1970 Morgan ..... 114/230.13
4,634,314 A * 1/1987 Pierce ..... 166/350
4,728,224 A 3/1988 Salama et al.

FOREIGN PATENT DOCUMENTS

GB 2326177 A 12/1998
NO 159546 B 10/1988
WO WO 98/36150 A1 8/1998

OTHER PUBLICATIONS

International Search Report for PCT/NO99/00122, Aug. 5, 1999.
International Preliminary Examination Report for PCT/NO99/00122, Aug. 10, 2000.

* cited by examiner

*Primary Examiner*—David Bagnell
*Assistant Examiner*—Jennifer R. Dougherty
(74) *Attorney, Agent, or Firm*—Alston & Bird LLP

(57) ABSTRACT

A composite riser for transporting fluids between a location on a seabed and an installation near or at the surface of the sea comprises an outer sheath of tubular form extending longitudinally in a lengthwise direction of the riser, a plurality of spacing members arranged within the outer sheath so as to define a plurality of longitudinally extending channels in the outer sheath from one end to an opposite end of the riser, and a plurality of fluid-carrying tubes disposed in the channels such that the tubes are freely movable in the lengthwise direction of the riser relative to the outer sheath, the tubes being constructed of fiber-reinforced plastic material. One or more tension members are disposed in the channel(s) and are freely movable relative to the outer sheath in the longitudinal direction.

10 Claims, 2 Drawing Sheets

COMPOSITE HYBRID RISER

CROSS-REFERENCE TO RELATED APPLICATION

This application is a continuation of International Patent Application No. PCT/NO99/00122 filed Apr. 15, 1999, which designated inter alia the United States and was published under PCT Article 21(2) in English.

FIELD OF THE INVENTION

The present invention relates to a composite hybrid riser for carrying fluid between the seabed and a surface installation.

BACKGROUND OF THE INVENTION

In present day oil production, several risers are arranged between the seabed and a surface installation such as a platform or a production ship. The risers may be either flexible or rigid. Lately, a number of concepts have been suggested, such as the concept shown in FIG. 1, in which a plurality of rigid risers are bundled together to form a hybrid riser 21, which is led up to a buoyancy member 22 near or at the sea surface 23. Fluids are transferred between the floating production unit 24 and the buoyancy member 22 through flexible risers 25, the advantages being that the buoyancy member and the couplings are maintained at a level where the effects of waves and wind are small, and the very expensive flexible risers, which are also subject to depth limitations, are only used for the transfer between the buoyancy member and the floating production unit. Such a solution has been disclosed in NO 159.546, which also includes a piping sheath enclosing the transport tubes.

However, the above solutions employ conventional steel tubing for transport of fluids, and tension members in the form of steel wires. This makes the riser very heavy, and leads to a requirement for a large buoyancy element. In water depths exceeding approximately 1000 metres, such risers can not be used, as the pipe wall thicknesses required due to the pressure are so large, as to make the riser so heavy that it would be practically impossible to obtain sufficient buoyancy. The tension in such a pipe would also exceed that which is possible to handle. In addition to the high buoyancy requirement, there would also be a requirement for a sturdy foundation on the seabed. Needless to say, building such a foundation at great depths is very costly.

Another disadvantage, which applies also at depths significantly less than 1000 metres, is associated with manufacture and tow-out of the riser. If the riser is manufactured onshore as one whole length or as long sections, for later tow-out to the installation site, the transportation itself will cause fatigue in the riser. Such fatigue shortens the expected working life of the riser, maybe by as much as 10%. The transportation distance therefore has to be as short as possible, thus limiting the number of possible manufacturing sites.

If the riser is to be put together from relatively short sections, which are transported on board for example a barge, the installation process will be made more expensive.

SUMMARY OF THE INVENTION

The present invention aims to provide a composite hybrid riser, which comprises those pipelines and cables normally needed between the seabed and a surface installation, and which does not or to a very much smaller degree exhibits the above mentioned disadvantages. This is achieved through the features stated in claim 1.

The present invention achieves a formidable weight saving, as components made from composite materials have a weight that is only a fraction of that of steel components. As a result of the weight saving, the requirements for buoyancy and foundation work are reduced.

Further, the fatigue life is increased to up to 10 times that of steel. Transportation to the installation site will therefore only cause a negligible reduction in the fatigue life, consequently the tow-out distance is not of critical importance, and the choice of manufacturing sites will be considerably greater.

Small dimension risers according to the invention may be coiled on the deck of a barge during shipment, thus simplifying transportation considerably.

A lighter and more flexible riser also makes installation easier. The capacity of cranes, winches and other equipment used may be reduced considerably. Installation may also be speeded up, due to the low weight and increased flexibility, and to the fact that the riser according to the invention tolerates a greater strain.

BRIEF DESCRIPTION OF THE DRAWINGS

The invention will now be described by reference to a preferred embodiment of the invention shown in the appended drawings, in which.

DETAILED DESCRIPTION OF A PREFERRED EMBODIMENTS.

Figure 1:
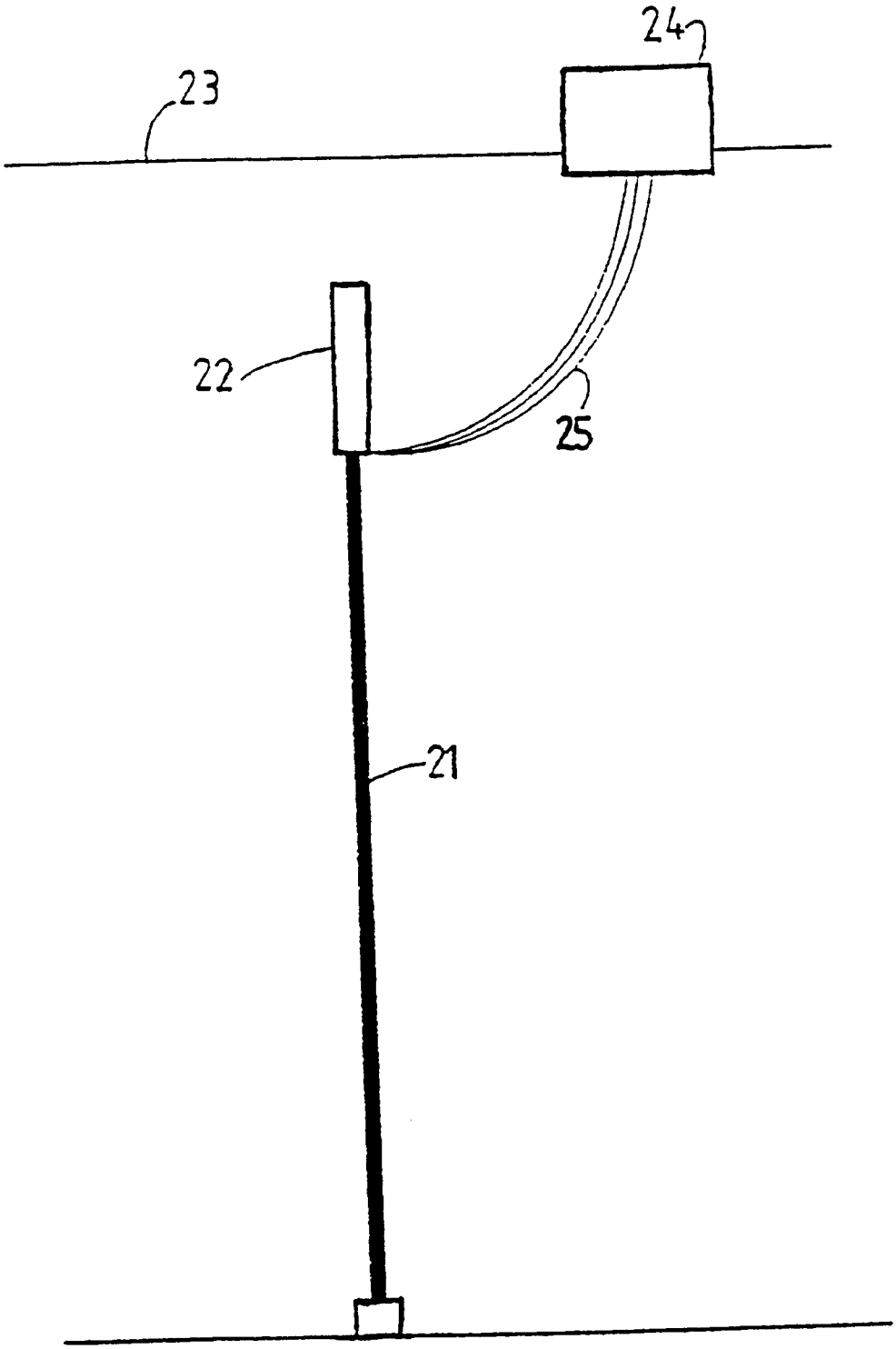
FIG. 1 is a diagrammatic view showing a riser installation on a sea bed.
Figure 2:
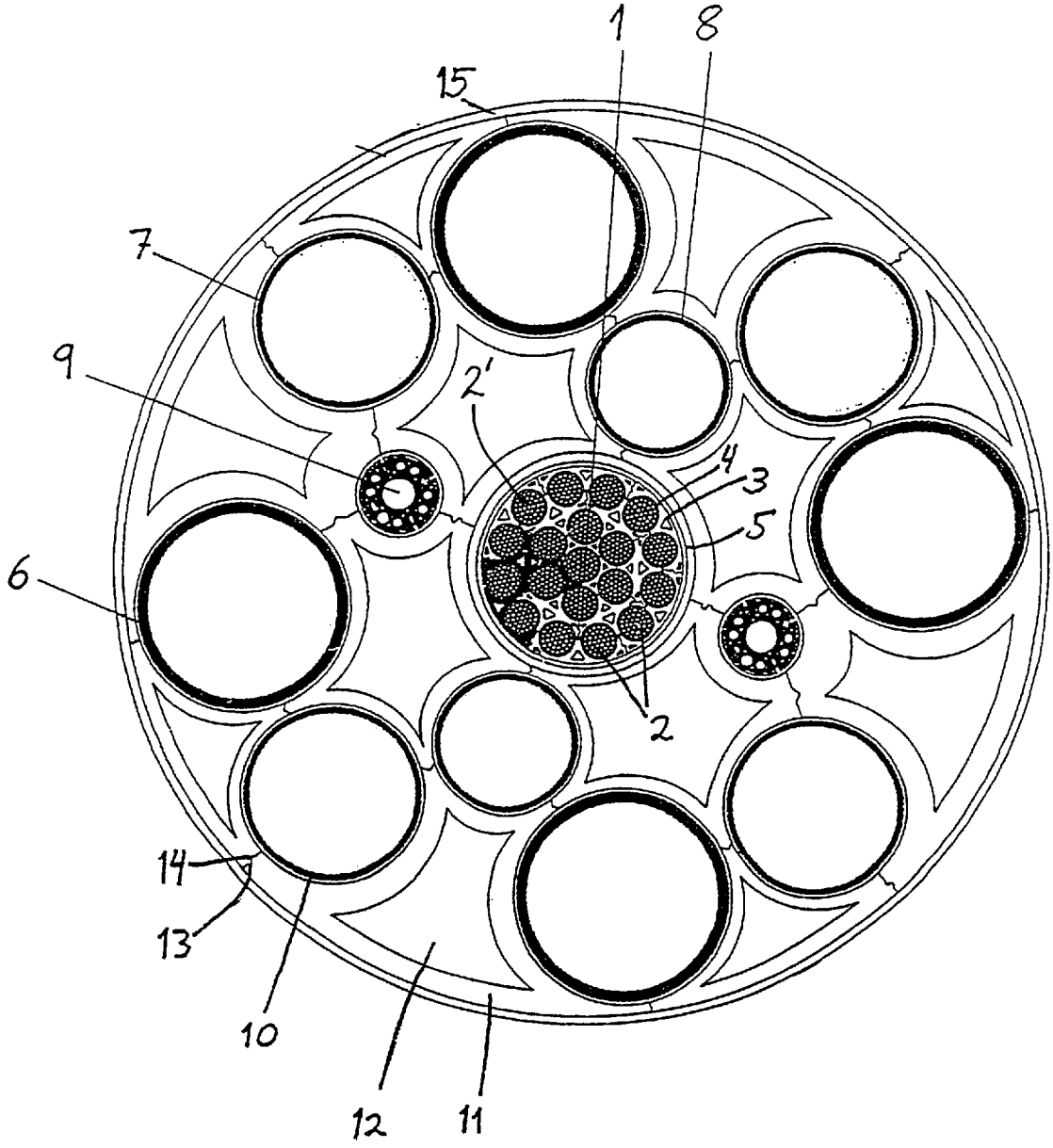
FIG. 2 is a cross-sectional view of a riser in accordance with a preferred embodiment of the invention.

Reference is made to FIG. 2, which shows a cross section through a composite hybrid riser according to the present invention.

The composite hybrid riser according to the invention comprises a centrally disposed tension member 1, which comprises a plurality of strands 2, preferably light, strong fibres such as carbon fibre, glass fibre or aramid fibre, in a matrix of plastic material, e.g. epoxy resin, and spacers 3, which have been arranged so as to keep the strands spaced apart, and which define channels 4, in which the strands 2 are freely movable in the longitudinal direction. Preferably, the strands are coiled around the tension member, e.g. in a coil or a Z-wrap. This technology has been described in detail in . . . the same applicant. The tension member is connected to a foundation on the seabed through one end, and to a buoyancy body through the other end. Instead of or in addition to a centrally disposed tension member 1, there may be an arrangement of several non-centrally disposed tension members.

An enclosing sheath 5 holds the tension member 1 together. The composite hybrid riser according to the invention also consists of a plurality of fluid transport tubes 6, 7 and 8, of various dimensions, for transport of production fluid and/or for water injection. In special cases with small requirements for tensile strength, or where the pipelines themselves have sufficient tensile strength, it is possible to eliminate the central tension member, with the tubes 6, 7 and 8 themselves acting as tension members.

The composite hybrid riser may also comprise control cables 9, which again comprise signal cables, electrical conductors, hydraulic lines, fluid transport tubes and other items normally included in a conventional control cable. These cables and lines are suitably arranged in the respective channels, in such a manner as has been described for control cables, or so-called umbilicals, in Norwegian patent 174940 by the same applicant.

Each tube 6, 7 and 8, as well as control cables 9, are arranged so as to be freely moveable in the longitudinal direction in their respective channels 10, which are defined by spacers 11. The spacers are preferably designed with one or more cavities 12, which during installation may be filled with air, water or another medium such as synthetic foam, in order to control the buoyancy. In order to keep the spacers in place, relative to each other, projections 13 and recesses 14 have been formed on the surfaces where the spacers 11 touch. Preferably, the spacers are elongated and extend over the whole or large parts of the length of the composite hybrid riser.

The tubes 6, 7 and 8 may be arranged in a straight line, or they may be wound around the tension member 1, e.g. in a coil or a Z-wrap. This makes the riser more flexible, and easier to coil. The tubes 6, 7 and 8 are made from a composite material comprising a matrix of plastic material, e.g. an epoxy resin such as HDPE. The tubes may for instance be constructed by winding the fibres in multiple layers, with the fibres preferably arranged in parallel, and with at least some of the layers intersecting. A matrix of plastic material is placed between each layer of fibres, enclosing the fibres completely. This gives a high resistance to external, physical influences. The tubes may, if desired, be constructed from pre-impregnated fibres, so-called prepreg. These are fibres that have been coated with plastic material in advance. The plastic material is treated after or during the winding of the fibres, for instance with heat, in order to cause it to melt completely or partially, for it to run together to form a continuous matrix.

The tubes 6, 7 and 8 may be manufactured as a whole length, or they may consist of several tube sections, which are joined during the manufacture of the riser.

An outer, protective sheath 15 is arranged around the complete composite hybrid riser, in order to keep the elements in their place, in relation to each other. The outer sheath is preferably made from PVC.

Since the tubes 6, 7 and 8 and the control cables 9 are freely moveable in the longitudinal direction in the channels 10, it will be possible in certain cases, particularly when the dimensions are small, to coil the composite hybrid riser for transportation to the installation site. If the dimensions of the riser are so great as to make coiling practically impossible, it will be possible to tow it to the installation site, for instance suspended between two towing vessels. As the riser, irrespective of dimensions, has a certain flexibility that is greater than that of a correspondingly dimensioned steel riser, it will be able to absorb relatively large movements without being overloaded or fatigued.

The tow can therefore take place under conditions of greater wave heights than those that are allowable for a steel riser.

Moreover, the above construction makes it possible to obtain a riser that contains fewer reinforcing fibres, and has a comparatively small diameter, which will give a further reduction of the bend radius.

The central tension member may be pretensioned during installation, so as to absorb all static and dynamic loads. Thus, the tubes and the remaining elements of the riser will not be subjected to any significant loads. It is also possible for the tension member to take over the task of anchoring the floating installation to the seabed, either by itself or in combination with tension legs or other risers.

A fibre-optic cable 2' (FIG. 2) may be included with the fibres in the tension member. The tension and the structural integrity of the tension member may be monitored through this, in order to keep account of the state of fatigue in the tension member, prevent overloading, and to receive an early warning of any weakening of the tension member.

What is claimed is:

1. A composite riser for transporting fluids between a location on a seabed and an installation near or at the surface of the sea, comprising:

an outer sheath of tubular form extending longitudinally in a lengthwise direction of the riser;

a plurality of spacing members arranged within the outer sheath so as to define a plurality of longitudinally extending channels in the outer sheath from one end to an opposite end of the riser, each spacing member having a length extending at least partially along a length of the outer sheath;

a plurality of fluid-carrying tubes disposed in the channels such that the tubes are freely movable in the lengthwise direction of the riser relative to the outer sheath, the tubes being constructed of fiber-reinforced plastic material; and at least one tension member disposed in one of the channels and extending between the ends of the riser for supporting at least a major portion of tension loads imposed on the riser in operation, the tension member being constructed of fiber-reinforced plastic material and being freely movable in the lengthwise direction of the riser relative to the outer sheath.

2. The composite riser of claim 1, wherein the tension member is centrally disposed within the outer sheath.

3. The composite riser of claims 1, wherein the tension member comprises a plurality of strands of fiber-reinforced plastic material and a plurality of spacers disposed between the strands for maintaining the strands at a distance from one another, the spacers collectively defining a plurality of channels in which the strands are freely movable in the lengthwise direction of the riser.

4. The composite riser of claim 1, further comprising a fiber optic cable included with fibers of the tension member for monitoring a physical state of the tension member.

5. The composite riser of claim 1, comprising at least one control cable disposed in one of the channels so as to be freely movable in the channel in the lengthwise direction of the riser.

6. The composite riser of claim 1, wherein the spacing members define internal cavities therein for containing a buoyancy-control medium.

7. The composite riser of claim 1, wherein each of the tubes extends in one continuous length from the one end to the opposite end of the riser.

8. The composite riser of claim 1, wherein the outer sheath is constructed of plastic.

9. A composite riser for transporting fluids between a location on a seabed and an installation near or at the surface of the sea comprising:

an outer sheath of tublar form extending longitudinally in a lengthwise direction of the riser;

a plurality of spacing members arranged within the outer sheath so as to define a plurality of longitudinally extending channels in the outer sheath from one end to an opposite end of the riser, each spacing member having a length extending at least partially along a length of the outer sheath;

a plurality of fluid-carrying tubes disposed in the channels such that the tubes are freely movable in the lengthwise direction of the riser relative to the outer sheath, the tubes being constructed of fiber-reinforced plastic material; and further comprising at least one control cable disposed in one of the channels so as to be freely moveable in the channel in the lengthwise direction of the riser;

wherein the at least one control cable includes longitudinally extending control lines disposed in channels within the control cable, and wherein the control lines are freely movable in the respective channels in the lengthwise direction of the riser.

10. A composite riser for transporting fluids between a location on a seabed and an installation near or at the surface of the sea comprising:

end of the riser, each spacing member having a length extending at least partially along a length of the outer sheath;

a plurality of fluid-carrying tubes disposed in the channels such that the tubes are freely movable in the lengthwise direction of the riser relative to the outer sheath, the tubes being constructed of fiber-reinforced plastic material; and wherein adjacent ones of the spacing members are joining together by interlocking members formed on the spacing members.

* * * * *

UNITED STATES PATENT AND TRADEMARK OFFICE

CERTIFICATE OF CORRECTION

PATENT NO. : 6,612,370 B1
DATED : September 2, 2003
INVENTOR(S) : Jahnsen et al.

It is certified that error appears in the above-identified patent and that said Letters Patent is hereby corrected as shown below:

Column 4,
Line 43, after "claim 1," insert -- further --.
Line 55, Claim 9, should read as follows:

--9. A composite riser for transporting fluids between a location on a seabed and an installation near or at the surface of the sea, comprising:

an outer sheath of tubular form extending longitudinally in a lengthwise direction of the riser;

a plurality of spacing members arranged within the outer sheath so as to define a plurality of longitudinally extending channels in the outer sheath from one end to an opposite end of the riser, each spacing member having a length extending at least partially along a length of the outer sheath;

a plurality of fluid-carrying tubes disposed in the channels such that the tubes are freely movable in the lengthwise direction of the riser relative to the outer sheath, the tubes being constructed of fiber-reinforced plastic material; and further comprising at least one control cable disposed in one of the channels to as to be freely moveable in the channel in the lengthwise direction of the riser;

wherein the at least one control cable includes longitudinally extending control lines disposed in channels within the control cable, and wherein the control lines are freely movable in the respective channels in the lengthwise direction of the riser.--.

Column 5,
Line 12, Claim 10, should read as follows:

--10. A composite riser for transporting fluids between a location on a seabed and an installation near or at the surface of the sea, comprising:

an outer sheath of tubular form extending longitudinally in a lengthwise direction of the riser;

a plurality of spacing members arranged within the outer sheath so as to define a plurality of longitudinally extending channels in the outer sheath from one end to an opposite end of the riser, each spacing member having a length extending at least partially along a length of the outer sheath;

a plurality of fluid-carrying tubes disposed in the channels such that the tubes are freely movable in the lengthwise direction of the riser relative to the outer sheath, the tubes being constructed of fiber-reinforced plastic material; and wherein adjacent ones of the spacing members are joined together by interlocking members formed on the spacing members.--.

Signed and Sealed this

Twentieth Day of January, 2004

Jon W. Dudas

JON W. DUDAS
*Acting Director of the United States Patent and Trademark Office*

UNITED STATES PATENT AND TRADEMARK OFFICE

CERTIFICATE OF CORRECTION

PATENT NO. : 6,612,370 B1
DATED : September 2, 2003
INVENTOR(S) : Jahnsen et al.

It is certified that error appears in the above-identified patent and that said Letters Patent is hereby corrected as shown below:

Column 4,
Line 43, after "claim 1," insert -- further --.
Line 55, Claim 9, should read as follows:

--9. A composite riser for transporting fluids between a location on a seabed and an installation near or at the surface of the sea, comprising:

an outer sheath of tubular form extending longitudinally in a lengthwise direction of the riser;

a plurality of spacing members arranged within the outer sheath so as to define a plurality of longitudinally extending channels in the outer sheath from one end to an opposite end of the riser, each spacing member having a length extending at least partially along a length of the outer sheath;

a plurality of fluid-carrying tubes disposed in the channels such that the tubes are freely movable in the lengthwise direction of the riser relative to the outer sheath, the tubes being constructed of fiber-reinforced plastic material; and further comprising at least one control cable disposed in one of the channels to as to be freely moveable in the channel in the lengthwise direction of the riser;

wherein the at least one control cable includes longitudinally extending control lines disposed in channels within the control cable, and wherein the control lines are freely movable in the respective channels in the lengthwise direction of the riser.--.

Column 5,
Line 12, Claim 10, should read as follows:

--10. A composite riser for transporting fluids between a location on a seabed and an installation near or at the surface of the sea, comprising:

an outer sheath of tubular form extending longitudinally in a lengthwise direction of the riser;

a plurality of spacing members arranged within the outer sheath so as to define a plurality of longitudinally extending channels in the outer sheath from one end to an opposite end of the riser, each spacing member having a length extending at least partially along a length of the outer sheath;

a plurality of fluid-carrying tubes disposed in the channels such that the tubes are freely movable in the lengthwise direction of the riser relative to the outer sheath, the tubes being constructed of fiber-reinforced plastic material; and wherein adjacent ones of the spacing members are joined together by interlocking members formed on the spacing members.--.

Signed and Sealed this

Tenth Day of February, 2004

JON W. DUDAS
*Acting Director of the United States Patent and Trademark Office*